US005453666A

United States Patent [19]

Brown

[11] Patent Number: 5,453,666

[45] Date of Patent: Sep. 26, 1995

[54] HIGH INTENSITY DISCHARGE LAMP BALLAST HAVING A TRANSIENT PROTECTED POWER FACTOR CORRECTION SCHEME

[75] Inventor: Allan E. Brown, Palatine, Ill.

[73] Assignee: Philips Electronics North America Corporation, New York, N.Y.

[21] Appl. No.: 283,110

[22] Filed: Jul. 29, 1994

Related U.S. Application Data

[63] Continuation-in-part of Ser. No. 980,831, Nov. 24, 1992, which is a continuation-in-part of Ser. No. 856,771, Mar. 24, 1992, Pat. No.5,256,946.

[51] Int. Cl.[6] ..... H05B 41/16

[52] U.S. Cl. ..... 315/247; 315/91; 315/127; 315/362

[58] Field of Search ..... 315/247, 91, 362, 315/127, 128, 271

[56] References Cited

U.S. PATENT DOCUMENTS

| | | | |
|---|---|---|---|
| 4,785,390 | 11/1988 | Zelina et al. | 315/91 |
| 5,180,950 | 1/1993 | Nilssen | 315/127 |
| 5,396,153 | 3/1995 | Shackle | 315/247 |

*Primary Examiner*—Robert J. Pascal
*Assistant Examiner*—Reginald A. Ratliff
*Attorney, Agent, or Firm*—Edward Blocker

[57] ABSTRACT

A ballast for lighting a high intensity discharge lamp having a power factor correction scheme. The power factor correction scheme includes a triac. To prevent the triac from damage when the lamp is not lit and power line transients are present, the triac is turned ON. The triac is also turned ON whenever the lamp is lit.

22 Claims, 1 Drawing Sheet

HIGH INTENSITY DISCHARGE LAMP BALLAST HAVING A TRANSIENT PROTECTED POWER FACTOR CORRECTION SCHEME

CROSS-REFERENCE TO RELATED APPLICATIONS

This application is a continuation-in-part of U.S. patent application Ser. No. 07/980,831, filed Nov. 24, 1992, currently pending, which is a continuation-in-part of U.S. patent application Ser. No. 07/856,771, filed Mar. 24, 1992, which has issued as U.S. Pat. No. 5,256,946 on Oct. 26, 1993.

BACKGROUND OF THE INVENTION

This invention relates generally to a high intensity discharge (HID) lamp ballast and, more particularly, to an HID lamp ballast having a transient protected power factor correction scheme.

An HID lamp generally refers to a family of lamps including high pressure mercury, high pressure sodium, metal halide and low pressure sodium. A conventional ballast for powering an HID lamp often includes a capacitive power factor correction scheme which is responsive to and employed when the HID lamp is lit. The power factor correction scheme is not used when the HID lamp is not lit. Otherwise, a relatively high current level drawn by the ballast prior to the lamp being lit will limit the number of power factor correction ballasts which can be connected to a branch utility power line (i.e. protected by a circuit breaker).

The responsiveness of the power factor correction scheme to the HID lamp status (i.e., lit or not lit) can be provided by a switching device, the switching device being turned ON and OFF based on the HID lamp status. When the HID lamp is lit, the switching device (e.g. a thyristor such as a triac) is turned ON which permits the power factor correction scheme to draw capacitive current thereby improving the ballast power factor.

Power line transients (i.e. transients having voltages substantially above the normal peak ballast input voltage), however, are often above the voltage breakover of the triac resulting in the triac being turned ON when it should be turned OFF. Under such conditions, current crowding (i.e. carrier current concentrated in a narrow stream) within the triac can occur. Overheating of the triac silicon material and subsequent failure of the triac can result.

Accordingly, it is desirable to provide an improved HID ballast having a more reliable power factor correction scheme. The power factor correction scheme, in particular, should be protected from power line transients to more reliably control when the scheme is employed.

SUMMARY OF THE INVENTION

Generally speaking, in accordance with a first aspect of the invention, a ballast for lighting a lamp includes a first path along which a first switching signal travels based on the lamp being lit and a second path along which a second switching signal travels when in the presence of power line transients. The ballast also includes a switching device and corrective circuitry. The switching device provides an interruptible, electrically conductive path therethrough based on the first and second switching signals. The first and second switching signals are generally gate currents for turning ON the switching device. The corrective circuitry is responsive to the establishment of the electrically conductive path through switching device (i.e. responsive to the switching device being turned ON) for improving the power factor of the ballast. Damage to the switching device from power line transients is avoided by turning ON the switching device whenever the switching device is exposed to power line transients. Consequently, current crowding within a triac serving as the switching device when exposed to power line transients is avoided. Overheating of the triac silicon material and subsequent failure of the triac is substantially eliminated.

The ballast also includes a choke to control the flow of current through the lamp. The choke includes a tap through which the first switching signal travels. The switching device preferably is a triac having a first main terminal and a gate included within the first path and the second path.

The second path source includes at least one bilateral switching device and a resistor. Preferably, two SIDACs and resistor are serially connected together. When a power line transient is applied to the switching device, the breakover voltage of the SIDACs is reached or exceeded placing the SIDACs in a conductive state. Gate current (i.e. the second switching signal) flows along the second path so as to turn ON the triac.

The corrective circuitry and switching device are serially connected together. A portion of the second path is connected in parallel with the serial combination of the switching device and corrective circuitry.

It is a feature of the invention to also include a bypass device for diverting a portion of a certain type of first switching signal away from the switching device. Consequently, the switching device is nonresponsive to production of the certain type of first switching signal.

The ballast also includes starting circuitry for producing ignition pulses. The certain type of first switching signal is produced by the choke based on the ignition pulses.

The ballast also includes an optional auxiliary lamp which is connected in parallel with the switching device. The switching device typically includes an inductor to limit inrush currents.

In accordance with a second aspect of the invention, a transient protected, power factor correction device for a ballast includes correcting circuitry for drawing capacitive current, a switching device and protective circuitry. Capacitive current flows through the switching device when the switching device is turned ON (i.e., placed in a conductive state). In other words, the switching device controls the correcting device based on whether the switching device is in a conductive or nonconductive state. The protective circuitry turns ON the switching device only when a power line transient is applied to the switching device thereby protecting the switching device from overheating when subjected to the power line transients.

In accordance with a third aspect of the invention, a method for operating a ballast for powering a high density discharge lamp includes the steps of producing a first switching signal reflecting the flow of current through the lamp, producing a second switching signal only when a power line transient is applied to a switching device and correcting the power factor of the ballast by increasing the level of capacitive current drawn from a power line based on the first switching signal and second switching signal.

In accordance with this third aspect of the invention, the method also includes supplying the first switching signal and second switching signal to a switching device for turning ON the latter whereby capacitive current flows therethrough.

Accordingly, it is an object of the invention to provide an improved HID ballast having a more reliable power factor correction scheme.

It is another object of the invention to provide an improved power factor correction scheme for an HID ballast which is less likely to fail when subjected to power line transients.

Still other objects and advantages of the invention, will, in part, be obvious, and will, in part, be apparent from the specification.

The invention accordingly comprises several steps in the relation of one or more such steps with respect to each of the others, and the device embodying features of construction, combination of elements and arrangements of parts which are adapted to effect such steps, all is exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawing in which.

DETAILED DESCRIPTION OF THE PREFERRED EMBODIMENT

Figure 1:
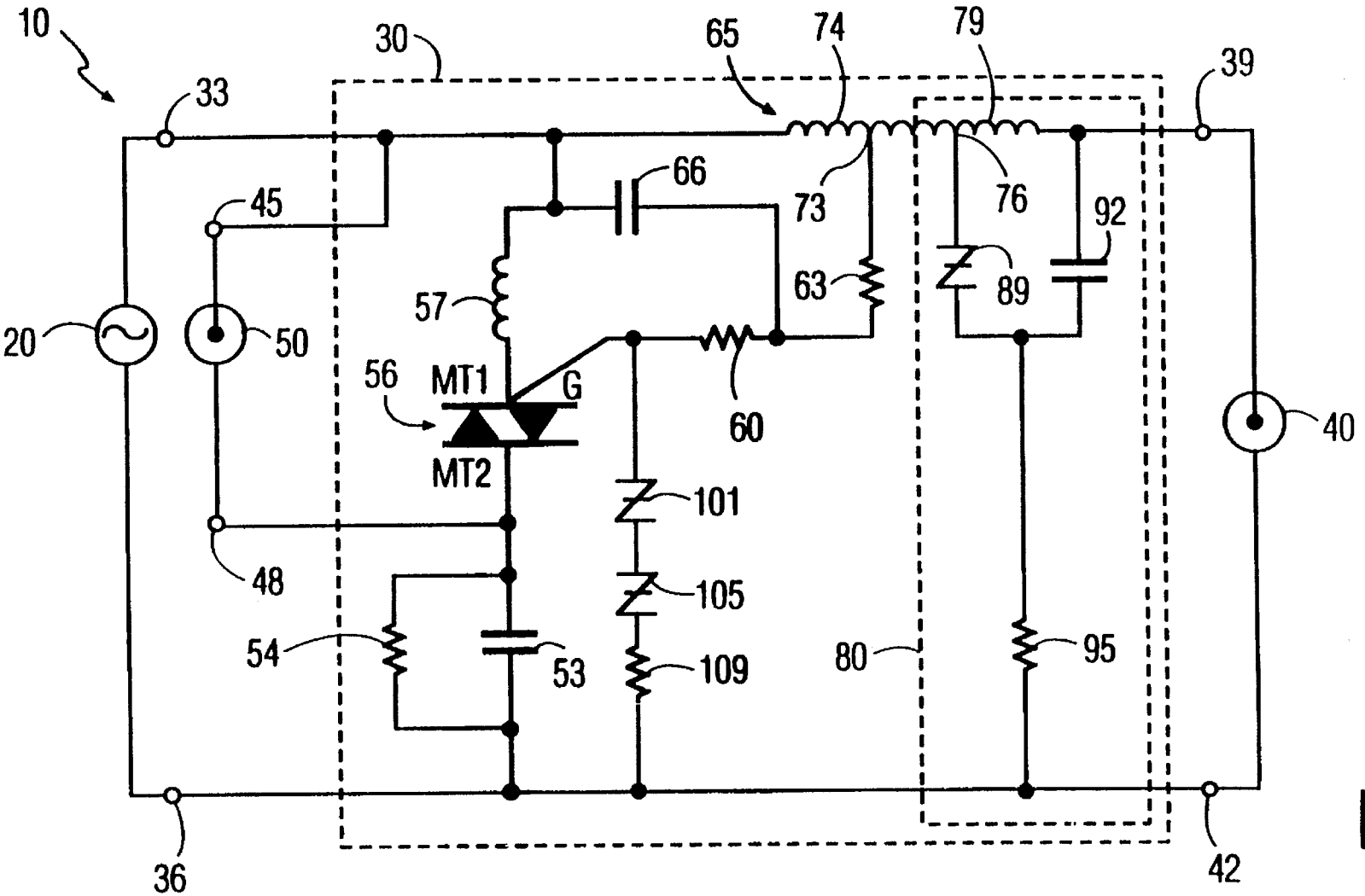
FIG. 1 is a lighting system in accordance with the invention.

As shown in FIG. 1, a lighting system 10 includes an A.C. source 20 connected to a pair of input terminals 33 and 36 of a ballast 30, an HID lamp 40 and an optional auxiliary lamp 50. Ballast 30 also includes a first pair of output terminals 39 and 42 to which HID lamp 40 is connected. Auxiliary lamp 50, which can be but is not limited to an incandescent type, is connected to a second pair of output terminals 45 and 48 of ballast 30. Although auxiliary lamp 50 is shown connected to output terminals 45 and 48, it is to be understood that auxiliary lamp 50 can be disconnected from ballast 30 without adversely affecting operation of ballast 30. Auxiliary lamp 50 serves to provide light when power is supplied by source 20 to ballast 30 and HID lamp 40 is not lit.

Ballast 30 further includes a power factor correction capacitor 53 connected in parallel with a discharge resistor 54. This parallel combination is connected at one end to input terminal 36 and at its other end to output terminal 48. A first main terminal MT1 of a triac 56 (or other suitable switching device) is connected to one end of an inductor 57. The other end of inductor 57 is connected to a junction joining together input terminal 33, output terminal 45, a ballast reactor/choke 65 and a bypass capacitor 66. A second main terminal MT2 of triac 56 is connected to a junction joining together capacitor 53, resistor 54 and output terminal 48. The serial combination of inductor 57 and triac 56 is connected in parallel with auxiliary lamp 50.

A gate G of triac 56 is connected through an impedance such as but not limited to, a pair of serially connected resistors 60 and 63, to a tap point 73 of ballast reactor 65 in providing a switching signal for turning ON and OFF triac 56. Resistors 60 and 63 serve, in part, to limit the current level of the switching signal supplied to gate G of triac 56. The portion of ballast reactor 65 between input terminal 33 and tap point 73 will hereinafter be referred to as a winding portion 74. The point at which ballast reactor 65 is tapped to resistor 63 is chosen, in part, so as to minimize the power consumed by resistors 60 and 63. Capacitor 66 is connected to a junction joining together resistors 60 and 63. A bilateral switching device such as, but not limited to, a pair of serially connected SIDACS 101, 105 is, in turn, serially connected to a resistor 109. SIDAC 101 is connected to a junction joining together resistor 60 and gate G of triac 56. Resistor 109 is connected to a junction joining together input terminal 36, output terminal 42, capacitor 53, resistor 54, and a resistor 95. As described below, capacitor 66 serves to bypass/divert a certain type of switching signal produced at tap 73. False triggering of triac 56 based on this type of switching signal is thereby avoided. As also described below, SIDACs 101, 105 and resistor 109 in combination serve as a protective device through which another switching signal can flow for turning ON triac 56 when line transients are applied to triac 56.

Ballast reactor/choke 65, which serves to limit/control the level of current flowing through lamp 40 when the latter is lit, is also connected at a tap point 76 to one end of a SIDAC 89. The other end of ballast reactor 65 is connected to output terminal 39 and to a capacitor 92. The portion of ballast reactor 65 connected between tap point 76 and capacitor 92 is hereinafter referred to as an ignitor winding 79. SIDAC 89 and capacitor 92 are also connected to one end of a resistor 95. The other end of resistor 95 is connected to the junction joining together capacitor 53, resistors 54 and 109, input terminal 36 and output terminal 42. Ignitor winding 79, SIDAC 89, capacitor 92 and resistor 95 serve in combination as an ignitor (i.e., starting circuit) 80.

Lighting system 10 operates as follows. Power is supplied from A.C. source 20 to input terminals 33 and 36 of ballast 30. The voltage produced by A.C. source 20 is insufficient to ignite/start lamp 40, the latter of which requires one or more supplemental starting pulses. The one or more pulses are provided by ignitor 80. More particularly, capacitor 92 based on the RC time constant of capacitor 92 and resistor 95 charges to the breakover voltage of SIDAC 89. Once the breakover voltage is reached, SIDAC 89 switches from its previous off-state to its on-state. A rapid flow of current now passes through and results in a voltage pulse produced across ignitor winding 79. The voltage pulse can be sufficient to ignite lamp 40. For example, when lamp 40 is of a metal halide type, nominally rated at 400 watts, 135 volts with SIDAC 89 having a breakover voltage of about 240 volts, a voltage pulse of about 240 volts is applied across ignitor winding 79. Through transformer action (i.e., ballast reactor 65 acting as an autotransformer) a voltage of about 1800 to 3500 volts is developed across output terminals 39,42. In the event lamp 40 does not start, the cycle of charging capacitor 92 until reaching the SIDAC breakover voltage resulting in the generation of a high voltage pulse applied to lamp 40 is repeated until lamp 40 ignites/starts.

Once lamp 40 is lit, the voltage across ignitor 80 will drop down to about 135 volts, that is, below the SIDAC breakover voltage of 240 volts. The voltage across ignitor 80 is now insufficient to produce a voltage pulse across ignitor winding 79. In other words, as long as lamp 40 remains lit, ignitor 80 will produce no additional voltage pulses.

Prior to and until lamp 40 reaches a predetermined level of illumination, auxiliary lamp 50 is lit, (e.g. triac 56 is in its open state). Lamp 50 is nominally rated at about 120 volts and when lit is serially connected to capacitor 53 (i.e. triac 56 being turned OFF). Capacitor 53 serves to limit the flow of current through lamp 50.

When HID lamp is initially lit (i.e. reaches at least a predetermined level of illumination), current flows through ballast 65. The level of current flowing through lamp 40 is controlled by ballast reactor 65. A switching signal representing/reflecting the flow of current through at least a portion of ballast reactor 65 is produced at tap 73 of winding portion 74. The switching signal is supplied to gate G through resistors 60 and 63 whereby triac 56 is turned/switched ON from its nonconductive to conductive state (i.e., provides an electrically conductive path therethrough). A substantially short circuit formed by inductor 57 and triac 56 effectively turns OFF auxiliary lamp 50. Inductor 57 serves to suppress high inrush currents which can damage triac 56. Power factor correction capacitor 53 with triac 56 turned ON draws a relatively large level of capacitive current thereby improving the power factor of ballast 30 (referred to hereinafter as the power factor correction scheme).

Whenever HID lamp 40 is turned OFF through, for example, a momentary or longer lasting power interruption, the level of the switching signal produced at tap 73 will be insufficient to turn ON triac 56 or maintain triac 56 in its conductive state. Triac 56 will now switch to its open/off state. Once power returns to input terminals 33, 36 and prior to lamp 40 being relit, light is provided by auxiliary lamp 50. During the period of time that power is not being supplied to input terminals 33, 36, resistor 54 provides a path for discharge of capacitor 53. The impedances of capacitor 53 and lamp 50 are chosen such that whenever triac 56 is turned OFF sufficient current will flow through lamp 50 to light the latter.

In accordance with the invention, the power factor correction scheme when not being employed to offset the inductive component of current flowing through lamp 40 (i.e. when triac 56 is turned OFF) results in less current being drawn from A.C. source 20 than may be otherwise drawn by a conventional power factor correction scheme in which a capacitor is always connected across A.C. source 20. Consequently, as compared to such conventional ballasts, a greater number of ballasts in accordance with the invention can be connected to a branch utility power line.

In starting/igniting lamp 40, a series of voltage pulses at a frequency of about 120 Hz for about 2 to 3 seconds is typically developed across ignitor winding 79 of ignitor 80. A series of voltage pulses induced across winding portion 74 of reactor ballast 65 can result. The induced voltages across winding portion 74 can result in a switching signal being produced by winding portion 74 sufficient to turn ON triac 56. A switching signal formed from such induced voltage pulses can result in the false triggering of triac 56. False triggering of triac 56 can result in auxiliary lamp 50 being turned OFF and power factor correction capacitor 53 being placed across the mains voltage prior to a HID lamp 40 being lit. To avoid such false triggering that portion of the switching signal based on the ignition pulses is substantially diverted away from gate G of triac 53 by bypass capacitor 66. Consequently, triac 56 is nonresponsive to the switching signal prior to lamp ignition, that is, nonresponsive to the switching signal which is based on the ignition pulses (i.e., the switching signal produced during starting of lamp 40).

The conditions under which triac 56 is turned ON and OFF are of particular importance and specifically addressed by the invention. Capacitor 53 should be placed across the mains voltage (i.e. connected between input terminals 33, 36) by turning triac 56 ON for power factor correction when lamp 40 is lit. When lamp 40 is not lit, capacitor 53 should be disconnected from the mains voltage by turning triac 56 OFF.

Maintaining triac 56 in its nonconductive state can be difficult when triac 56 is exposed to power line transients. As used herein, power line transients have voltages which are substantially above the normal peak line voltage applied to ballast 30 from A.C. source 20. Application of power line transients to triac 56 when the latter is turned OFF can result in voltage breakover of triac 56. Under such conditions, current crowding within triac 56 and subsequent overheating of the triac silicon material can occur. For example, when the normal peak line voltage from A.C. source 20 is 277 volts, a voltage of about 430 volts or above (i.e. 277 volts×2×110%) would be considered a power line transient. It is to be understood, however, that the voltage value chosen at which a power line transient occurs can be less than or greater than the foregoing example. A power line transient should be considered as including any voltage which when applied to a triac (turned OFF) will cause voltage breakover of the triac.

To protect triac 56 from damage due to power line transients, the combination of SIDACs 101, 105 and resistor 109 provide a path for gate current for turning ON triac 56. More particularly, ballast 30 includes two different paths along which gate current can flow for turning ON triac 56. During normal operation (i.e. when lamp 40 is lit), gate current (i.e. a switching signal) flows along a path which includes winding portion 74, tap 73, resistors 60, 63, gate G and main terminal MT1 of triac 56 and inductor 57.

When power line transients are produced by A.C. source 20 and lamp 40 is not lit, the line transients will exceed the breakover voltage of SIDACs 101 and 105 so as to provide a path along which the gate current travels to turn ON triac 56. This path includes A.C. source 20, inductor 57, main terminal MT1 and gate G of triac 56, SIDACs 101, 105 and resistor 109.

In other words, by turning ON triac 56 current crowding and associated overheating of the silicon material of triac 56 (due to the power line transients) is avoided.

In accordance with the preferred embodiment of the invention, A.C. source 20 produces an A.C. voltage of about 277 volts. Capacitor 53 is nominally rated at about 20 microfarads. Auxiliary lamp 50 is nominally rated at about 250 watts, 120 volts and is of the quartz incandescent type. Resistors 60 and 63 are each rated at about 150 ohms, 2 watts. Resistors 95, 54 and 109 are nominally rated at 19,000 ohms, 7 watts; 470,000 ohms, ½ watt, and 4,700 ohms, 1 watt, respectively. Ballast reactor/choke 65 is a one and one-half EI lamination, 400 watt metal halide reactor ballast having total turns of 468 with tap points 73 and 76 at about the 36th and 453th turn, respectively. Triac 56 is nominally rated at 15 amps, 800 volts and is available from Teccor Inc. of Hurd, Tex. as Part No. Q8015L5. SIDACs 101 and 105 are each available from Shindengen Electric Mfg., Co., Ltd of Tokyo, Japan Inc. as Part No. K1V26 and have a nominally rated breakover voltage of about 240–270 volts. SIDAC 89 is also available from Shindengen Electric Mfg. Co., Ltd. as Part No. K1V24 and has a nominally rated breakover voltage of about 220–250 volts. Capacitor 92 is nominally rated at about 0.15 microfarads. Lamp 40 is a high intensity discharge type, such as but not limited to, a 400 watt, 135 volt metal halide type. Inductor 57 is nominally rated at 0.06 millihenries. Capacitors 66 and 92 are nominally rated at 5.6 microfarads and 0.1 microfarads, respectively.

As now can be readily appreciated, the invention provides an improved ballast scheme in which triac 56 is protected from power line transients prior to lamp 40 being lit. False triggering of triac 56 during starting of lamp 40 is also substantially eliminated. An optional auxiliary light source (i.e. lamp 50) is turned ON whenever the primary/main light source (i.e. lamp 40) has not reached a predetermined level of illumination. When this predetermined level of illumination is reached, triac 56 in combination with inductor 57 substantially short circuits auxiliary lamp 50 whereby lamp 50 is effectively turned OFF. At the same time (i.e. when lamp 40 is lit), the power factor of power drawn by ballast 30 is increased by substantially balancing the capacitive and inductive components of current drawn from A.C. source 20.

It will thus be seen that the objects set forth above and those made apparent from the preceding description, are efficiently obtained and since certain changes may be made in the above construction without departing from the spirit and scope of the invention, it is intended that all matter contained in the above description and shown in the accompanying drawings shall be interpreted as illustrative and not in a limiting sense.

It is also to be understood that the following claims are intended to cover all the generic and specific features of the invention hereindescribed, and all statements of the scope of the invention which, as a matter of language, might be said to fall therebetween.

What is claimed is:

1. A ballast for lighting a lamp, comprising:

a first path along which a first switching signal travels based on the lamp being lit;

a second path along which a second switching signal travels only when in the presence of a power line transient;

switching means for providing an interruptible, electrically conductive path therethrough based on the first switching signal and second switching signal; and corrective means responsive to the establishment of the electrically conductive path through the switching means for improving the power factor of the ballast.

2. The ballast of claim 1, further including a choke having a tap wherein the first switching signal flows through the tap.

3. The ballast of claim 1, wherein said switching means includes a triac having a main terminal and a gate, the main terminal and gate being included within the first path and the second path.

4. The ballast of claim 3, wherein said corrective means and switching means are serially connected together and in parallel with a portion of said second path.

5. The ballast of claim 1, wherein the second path includes at least one bilateral switching device having a breakover voltage less than the voltage of the power line transient.

6. The ballast of claim 2, further including bypass means for diverting a portion of a certain type of first switching signal away from said switching means such that said switching means is nonresponsive to production of the certain type of first switching signal.

7. The device of claim 6, further including starting means for producing ignition pulses, the certain type of switching signals being produced by the choke are based on the ignition pulses.

8. The ballast of claim 7, wherein said switching means includes a triac having a main terminal and a gate, the main terminal and gate being included within the first path and the second path.

9. The ballast of claim 7, wherein said bypass means includes a capacitor.

10. The ballast of claim 1, wherein said lamp is of the high intensity discharge type.

11. The ballast of claim 1, further including an auxiliary lamp, said switching means being connected in parallel with the auxiliary lamp.

12. The ballast of claim 2, wherein said corrective means and switching means are serially connected together and in parallel with a portion of said second path.

13. The ballast of claim 12, wherein the second path includes at least one bilateral switching device having a breakover voltage less than the voltage of the power line transient.

14. The ballast of claim 13, wherein said correcting means and switching means are serially connected together and in parallel with a portion of the second path.

15. The ballast of claim 14, wherein said switching means includes a triac having a main terminal and a gate, the main terminal and gate being included within the first path and the second path.

16. A transient protected, power factor correction device for a ballast, comprising:

correcting means for drawing capacitive current whereby the power factor of the ballast is improved;

switching means responsive to a switching signal for controlling said correcting means, said switching means operable for assuming a conductive and non-conductive state;

protective means for producing the switching signal only when a power line transient is applied to said switching means so as to place said switching means in a conductive state and thereby protect said switching means from voltage breakover when subjected to the power line transient.

17. The device of claim 16, wherein the switching means includes a triac having a gate.

18. The device of claim 17, wherein the protective means includes at least one bilateral device having a breakover voltage less than the voltage of the power line transient.

19. The device of claim 18, wherein the protective means includes two serially connected bilateral devices having a combined breakover voltage less than the voltage of the power line transient.

20. A method for operating a ballast for powering a high intensity discharge lamp, comprising the steps of:

producing a first switching signal only when current flows through the lamp;

producing a second switching signal only when a power line transient is applied to a switching device; and correcting the power factor of the ballast based on the presence of at least one of the first switching signal and second switching signal.

21. The method of claim 20, wherein the step of correcting includes increasing the level of capacitive current drawn from a power line.

22. The method of claim 21, further including supplying the first switching signal and second switching signal when produced to a switching device, the switching device providing an electrical path for flow of the capacitive current.

* * * * *